US005484674A

United States Patent [19]

Hor et al.

[11] Patent Number: 5,484,674

[45] Date of Patent: Jan. 16, 1996

[54] BENZIMIDAZOLE PERYLENE IMAGING MEMBERS AND PROCESSES THEREOF

[75] Inventors: Ah-Mee Hor, Mississauga; Charles G. Allen, Waterdown; Paul J. Gerroir, Oakville, all of Canada

[73] Assignee: Xerox Corporation, Stamford, Conn.

[21] Appl. No.: 331,464

[22] Filed: Oct. 31, 1994

[51] Int. Cl.[6] ..... G03G 5/06; G03G 5/047

[52] U.S. Cl. ..... 430/059; 430/58; 430/78; 430/135

[58] Field of Search ..... 430/59, 78, 135, 430/58

[56] References Cited

U.S. PATENT DOCUMENTS

| | | | |
|---|---|---|---|
| 3,871,882 | 3/1975 | Wiedemann | 430/58 |
| 3,904,407 | 9/1975 | Regensburger et al. | 430/58 |
| 4,265,990 | 5/1981 | Stolka et al. | 430/59 |
| 4,557,868 | 12/1985 | Page et al. . | |
| 4,587,189 | 5/1986 | Hor et al. | 430/59 |
| 5,019,473 | 5/1991 | Nguyen et al. | 430/58 |
| 5,225,307 | 7/1993 | Hor et al. | 430/136 |
| 5,395,722 | 3/1995 | Nukada et al. | 430/59 |

*Primary Examiner*—Roland Martin

*Attorney, Agent, or Firm*—E. O. Palazzo

[57] ABSTRACT

A process which comprises contacting the cis and trans isomers of benzimidazole perylene with cyclohexane.

4 Claims, No Drawings

BENZIMIDAZOLE PERYLENE IMAGING MEMBERS AND PROCESSES THEREOF

BACKGROUND OF THE INVENTION

The present invention is directed generally to photoresponsive imaging members, and more specifically, to photoconductive imaging members comprised of certain perylene photogenerating pigments. In embodiments, the present invention is directed to layered photoconductive imaging members comprised of certain benzimidazole perylenes, reference U.S. Pat. Nos. 4,587,189 and 5,225,307, the disclosures of which are totally incorporated herein by reference, and wherein perylenes with improved photosensitivity and dispersion quality can be generated by the contacting thereof with an organic solvent, and more specifically, with cyclohexane. Embodiments of the present invention are directed to imaging members comprised of a supporting substrate, a photogenerating layer comprised of the prepared perylene, and in contact therewith, and a charge, especially hole, transport layer. Imaging members with the photogenerating pigments of the present invention are sensitive to wavelengths of from about 400 to about 800 nanometers, that is throughout the visible and the near IR region of the light spectrum.

Generally, layered photoresponsive imaging members are described in a number of U.S. patents, such as U.S. Pat. No. 4,265,900, the disclosure of which is totally incorporated herein by reference, wherein there is illustrated an imaging member comprised of a photogenerating layer, and an aryl amine hole transport layer. Examples of photogenerating layer components include trigonal selenium, metal phthalocyanines, vanadyl phthalocyanines, and metal free phthalocyanines.

The use of selected perylene pigments as photoconductive substances is also known. There is thus described in Hoechst European Patent Publication 0040402, DE3019326, filed May 21, 1980, the use of N,N'-disubstituted perylene-3,4,9,10-tetracarboxyldiimide pigments as photoconductive substances. Specifically, there is, for example, disclosed in this publication N,N'-bis(3-methoxypropyl)perylene-3,4,9,10-tetracarboxyldiimide dual layered negatively charged photoreceptors with improved spectral response in the wavelength region of 400 to 700 nanometers. There are disclosed in U.S. Pat. No. 3,871,882 photoconductive substances comprised of specific perylene-3,4,9,10-tetracarboxylic acid derivative dyestuffs. In accordance with the teachings of this patent, the photoconductive layer is preferably formed by vapor depositing a dyestuff component in a vacuum. Also, there are specifically disclosed in this patent dual layer photoreceptors with perylene-3,4,9,10-tetracarboxylic acid diimide derivatives, which have spectral response in the wavelength region of from 400 to 600 nanometers.

Moreover, there are disclosed in U.S. Pat. No. 4,419,427 electrographic recording mediums with a photoconductive double layer comprised of a first layer containing charge carrier perylene diimide dyes, and a second layer with one or more compounds which are charge transporting materials when exposed to light, reference the disclosure in column 2, beginning at line 20.

Various types of perylene pigments, symmetrical as well as unsymmetrical structures, are known and are illustrated herein. Perylenes with these general structures can be prepared by reacting perylene tetracarboxylic acid dianhydride with primary amines or with diamines of aryl, alkyl, pyridyl, or naphthyl compounds. More specifically, the use of photoconductive perylene pigments obtained from perylene-3,4,9,10-tetracarboxylic acid dianhydride as photoconductors is disclosed in U.S. Pat. Nos. 3,871,882 and 3,904,407. The former patent illustrates the use of perylene dianhydride and bisimides in general (R=H, lower alkyl, like $C_1$ to $C_4$, aryl, substituted aryl, arylalkyl, a heterocyclic group or the NHR' group in which R' is phenyl, substituted phenyl or benzoyl) as vacuum evaporated thin charge generation layers (CGLs) in photoconductive devices coated with a charge transporting layer (CTL). The '407 patent, the disclosure of which is totally incorporated herein by reference, illustrates the use of general bisimide compounds (R=alkyl, aryl, alkylaryl, alkoxyl or halogen, or heterocyclic substituent) with preferred pigments being wherein R is chlorophenyl or methoxyphenyl. Perylenes and processes thereof are illustrated in U.S. Pat. Nos. 5,019,473 and 5,225,307, the disclosures of which are totally incorporated herein by reference.

Photoresponsive members contain a uniform layer of charge generator which is comprised of fine particles of photogenerator pigment. Consequently, there have been developed various processes to prepare the fine particles of pigment such that the final coating of the generator layer has a high dispersion quality, and controllable electrical and printing properties. However, photoresponsive elements containing photoconductive perylenes and the processes thereof described in a number of prior art references has certain deficiencies, for example with the processes of U.S. Pat. Nos. 4,587,189 (BZP) and 4,578,333 a vacuum coating process is selected to prepare a submicron thick charge generator layer for the photoresponsive member. This layer is usually thin, lacks substantial mechanical abrasion resistance, and can be easily damaged by rubbing and scratching during the handling processes. This can severely increase the defects in photoresponsive member which later cause printing defects. These and other problems are resolved or minimized with the processes of the present invention.

In another approach, sublimation process is selected to purify perylene pigments to remove detrimental impurities from the crude, assynthesized materials, reference U.S. Pat. No. 5,225,307. Following the purification, a certain polymer binder dispersion of perylene is prepared by milling pigment, binder and solvent in accordance with this conventional approach. The photoresponsive elements prepared from such dispersions suffer a significant loss in photosensitivity. Furthermore, there are various risks resulting from the prolonged milling process, for example, the polymer binder may break up into smaller fragments resulting in unstable dispersions due primarily to the loss of the stabilization effect provided by polymer, and the poor coating uniformity of the charge generator.

Premilling process is also commonly used in particle size reduction processes as practiced in the pigment and paint industries. Typically, the pigment is ground in the dry state with grinding media, such as steel balls, ceramic balls, or glass beads in jar mills, vibratory mills, or attritors. Inorganic salts, such as alkali halides, carbonates, sulfates or phosphates, are also added to the grinding mixture to improve process efficiency. High shear and mechanical impact forces produced in the grinding action break the pigment agglomerates into finer sizes. In U.S. Pat. No. 5,019,473 there is illustrated the use of dry premilling steps for reducing the particle size of perylene pigments prior to using them in preparing charge generator dispersions. Contaminants introduced by salts have to be thoroughly washed and removed, or separated from the pigments, otherwise final electrical and printing performance of the photoresponsive members would be severely adversely affected. These multiple processing steps involve milling, washing separation and drying which severely increase the cost of the manufacturing process and the process variability. Furthermore, certain perylene pigments may have a high adhesion force and thus tend to stick together as large agglomerates, and the dry milling process as described in U.S. Pat. No. 5,019,473 may not be effective in reducing the particle size. There is also a significant loss of material which remains stuck onto the wall of the preparation vessel used in processing the pigment, and a large particle size distribution is also observed.

Acid pasting process for reducing pigment particle size is also known. For example, in U.S. Pat. No. 4,557,868 a phthalocyanine was dissolved in concentrated sulfuric acid to form an acid mixture which was then diluted in water to produce fine particles of phthalocyanine. The resulting fine particles were used to form the charge generator of a photoresponsive member for electrophotographic applications. Many phthalocyanine pigments, such as VOPc, TiOPc, $H_2Pc$, and CuPc, have been reportedly treated in this manner. Unfortunately, the reaction of perylene and many pigments with acids result in chemical degradation and the formation of sulfonated products which finally leads to poor electrical charging properties in the charge generator layer. As a result, the acid pasting process is not particularly suitable for preparing high quality, photoconductive perylene pigments.

The aforementioned disadvantages are avoided and/or minimized with the processes of the present invention. More specifically, extensive research was accomplished with the primary objectives of simplifying the particle size reduction process for perylene pigments, and which processes are particularly useful in forming photoresponsive imaging members, and wherein the final electrical and printing characteristics are improved. In addition to small particle size, it is believed that narrow size distribution, and correct aspect ratio, the particle morphology of pigment can affect the properties of generator layer and hence the performance of photoresponsive members. For practical electrophotographic applications, a higher photosensitivity of photoresponsive members is desirable for achieving higher printing speed and better dispersion quality can significantly improve the electrical and printing quality. Less pigment agglomeration correspondingly minimizes the number of charge deficiency spots which can cause printing defects. More specifically, the perylene pigments of benzimidazole perylene pigments as synthesized and purified in U.S. Pat. No. 5,225,307 wherein perylene pigment particles of very large particle sizes, large size distribution and high aspect ratio were obtained from the sublimation process possess concerns relating to coating uniformity and the photosensitivity property of the final photoresponsive members. In accordance with embodiments of the present invention, large particles, up to one millimeter in length, of sublimed benzimidazole perylenes are subjected to milling in an organic solvent, preferably cyclohexane, to reduce to a smaller size <0.15 micron in length, and a low aspect ratio (length/width) equal or smaller than 3. The finely divided, cyclohexane treated perylene obtained can be selected for generating a charge generator dispersion. The perylene obtained from the cyclohexane treatment can be used directly in coating the charge generator. Alternatively, for achieving improved adhesion and mechanical properties in the final generator layer, the cyclohexane treated perylene can be redispersed in a polymer/solvent mixture to form a generator dispersion which is used to coat the generator layer. These dispersions permit significant improvements in coating uniformity of the charge generator layer and improvements in photosensitivity. It is believed that smaller size, low aspect ratio and more uniform particle size distribution in cyclohexane treated perylene are advantageous in enabling excellent dispersion quality of the generator layer and a photosensitivity improvement. Furthermore, the processes of the present invention are devoid of many of the difficulties encountered in prior art methods, such as contamination by salts, tedious washing and drying steps for separating pigment after the particle reduction process and the like. Once the perylene is processed in the cyclohexane, the fine particles can be conveniently redispersed in a polymer/solvent mixture to form the generator dispersion without a prolonged milling process and, therefore, there is eliminated the need of breaking the polymer into small fragments which would reduce the polymer's stabilizing power for the fine particles. Ideally, a photoconductive pigment used for light lens imaging, particularly for color photocopying, should have uniform spectral response, that is be panchromatic throughout the visible spectrum from 400 to 800 nanometers. More specifically, there is a need for the generation of perylenes with improved sensitivity thereby enabling their use in layered photoconductive imaging members that can be selected for high speed printing, for example 100 or more copies per minute, xerographic imaging and printing systems. Additionally, there is a need for photoconductive materials that enable imaging members with enhanced photosensitivity in the red and infrared wavelength regions of the light spectrum, enabling the resulting imaging members thereof to be selected for LED xerographic imaging processes and printers, and diode laser printer and imaging apparatuses.

SUMMARY OF THE INVENTION

It is an object of the present invention to provide imaging members with many of the advantages illustrated herein.

It is another object of the present invention to provide imaging members with photoconductive components with improved photosensitivity.

It is another object of the present invention to provide photoconductive imaging members with certain perylene photogenerating pigments that enable imaging members with enhanced photosensitivity from the visible to the near infrared wavelength regions of the light spectrum, such as from about 400 to about 800 nanometers.

It is another object of this invention to provide processes for the preparation of perylenes, especially benzimidazole perylenes, and layered imaging members thereof. More specifically, the cis and trans isomers of benzimidazole perylene mixture are described in U.S. Pat. Nos. 4,587,189 and 5,225,307, the disclosures of which are totally incorporated herein by reference. The cis isomer is bisbenzimidazo(2,1-a:1',2'-b')anthra(2,1,9-def:6,5,10-d'e'f')diisoquinoline-6,11-dione and the trans isomer is bisbenzimidazo(2,1-a:2',1'-a')anthra(2,1,9-def:6,5,10-d'e'f')diisoquinoline-10,21-dione. The benzimidazole perylene compositions (BZP) usually contain about 50 weight percent of the cis isomer, and about 50 weight percent of the trans isomer.

Another object of the present invention relates to solvent milling processes for the preparation of perylene pigments in general, and more specifically, to processes for milling benzimidazole perylene compositions in cyclohexane to achieve a small particle size of, for example, less than 0.15 micron in length and, more specifically, from about 0.05 to about 0.1 micron in length.

Another object of the present invention relates to cyclohexane processes for the preparation of benzimidazole perylenes, that is benzimidazole perylene with certain morphologies, such as brick shaped, and wherein the perylenes possess a low aspect ratio, length/width of less than 3 and, more specifically, from about 1 to about 3, as compared to larger and longer rod-shaped perylene particles, for example greater than 0.15 micron with an aspect ratio of greater than 5 when solvents, such as $CH_2Cl_2$, THF, toluene, methanol, DMF, and the like, are selected.

It is another object of this invention to provide processes for the preparation of perylenes, especially benzimidazole perylene, and layered imaging members thereof which contain uniformly dispersed pigment particles.

Another object of the present invention is the provision of processes wherein perylenes, such as sublimed BZP, are converted into fine pigmentary forms with a narrow particle size distribution, and which perylenes can be selected for the preparation of photogenerator dispersions, and wherein the BZP particle size is reduced to fine particles of less than 0.1 micron, and more specifically, from about 0.05 to about 0.1 micron in diameter, and a low aspect ratio (length/width) of less than about 3 microns, and more specifically, from about 1 to about 3.

These and other objects of the present invention are accomplished in embodiments by the provision of layered imaging members comprised of a supporting substrate, a photogenerating layer comprised of photogenerating pigments comprised of certain perylene compounds, benzimidazole perylene with improved properties, and wherein the perylenes are prepared with cyclohexane.

The processes of the present invention comprise processing the perylene pigments to reduce the particle size. The finely divided particles of perylene are advantageous in preparing a highly uniform, well dispersed coating of a thin generator layer of a thickness in the range of from about 0.2 to about 1 micron. More specifically, the process comprises the milling of large particles of benzimidazole perylene in an organic solvent, especially cyclohexane, and thereafter, applying the resulting mixture as a photogenerating layer in a photoconductive imaging member such as illustrated herein, reference for example U.S. Pat. No. 4,265,990, the disclosure of which is totally incorporated herein by reference. Optionally, additional polymer binder and solvent may be added to the cyclohexane treated perylene to form a coating solution for forming generator layer.

In embodiments, the present invention relates to a process which comprises contacting the cis and trans isomers of benzimidazole perylene with cyclohexane to reduce perylene particle size, and wherein the cis isomer is bisbenzimidazo(2,1-a:1',2'-b')anthra(2,1,9-def:6,5,10-d'e'f')diisoquinoline-6,11-dione, and the trans isomer is bisbenzimidazo(2,1-a:2',1'-a')anthra(2,1,9-def:6,5,10-d'e'f')diisoquinoline-10,21-dione, and wherein the contacting is accomplished by grinding in a jar mill, a ball mill, an attritor, a sand mill, a paint shaker, a dyno mill, or a drum tumbler, which contains round, spherical or cylindrical grinding beads of steel balls, ceramic cylinders, glass balls, round agates or stones. The contacting can be by grinding the benzimidazole perylene in cyclohexane for from about 1 day to about 10 days, and wherein the relative amount of benzimidazole perylene with respect to cyclohexane is from 1 to 15 percent by weight.

The photoresponsive members prepared contain perylene pigments with unique particle morphology properties related to the size, shape, aspect ratio (length/width), and size distribution. These unique pigment particles not only enable high photosensitivity in photoresponse imaging members, but also reduce the defects in the generator layers. Generally, large perylene particles greater than, for example, ten microns in size are formed in the synthesis or purification process. For instance, the sublimation purification process used in purifying perylene pigments as described in U.S. Pat. No. 5,225,307 yields perylene particles which are several millimeters in length. For the coating of a thin generator layer, 0.2 to 1 micron in thickness, in the photoresponsive members, small particles of size in submicron range, preferably less than 0.2 micron, are desired. Furthermore, the particle shape and morphology also could affect the uniformity of coated layer. Long needle-like particles have a tendency to flocculate into large aggregates and create an uneven deposition of pigment particles on a microscopic scale and hence lead to the formation of defect spots in the photoresponsive members. Typically, areas containing a large accumulation of pigments would produce higher discharging and areas where depletion of pigment occurs would have a decrease in discharge. These will significantly impact the printing quality of photoresponsive members such as resolution, image, uniformity, and image background.

With the present invention, the perylene pigments are milled in organic solvent or mixture of organic solvents of cyclohexane. Suitable milling, or grinding media include stainless steel balls, ceramic beads, glass beads, round stones and the like. The process conditions used depend, for example, on the type of perylene pigments desired, the properties of the final processed pigment desired, and the material and the processing equipment used. For sublimed benzimidazole perylene having large particles up to several millimeters in length, the jar mill process involves tumbling the pigment, like BZP in ⅛ inch stainless steel balls inside ceramic or glass jars. The jar is usually half filled with ⅛ inch steel balls, 1 part of pigment and 7 to 100 parts of the cyclohexane organic solvent. The jar is then placed on a Norton Company jar mill rotating at about 200 to 300 rpm. After 5 days, a slurry of perylene/cyclohexane is obtained. The particle size and morphology of pigment particles is assessed using electron microscopy. It was found that the cyclohexane milling solvent had a strong influence on the particle morphology. The cyclohexane generates fine brick shaped particles generally less than 0.15 micron in length and with an aspect ratio that is relatively small, for example the ratio of length to width is usually less than 3 microns, and preferably from about 0.1 to about 2.9 microns. Milling in methylene chloride, tetrahydrofuran or dimethylformamide leads to the formation of long needle-like particles which are generally greater than 0.15 micron in length and have high aspect ratio of greater than 5 microns. Long needle-like particles are known to flocculate easily in the dispersion. The overall film dispersion quality can be evaluated using an optical, microscope and visual inspection methods. The invention processed benzimidazole perylene materials are further coated onto metallized MYLAR® to form thin photogenerator films of about 0.5 to 1.0 micron in thickness, and wherein the optical properties thereof are excellent as measured with a spectrophotometer. A larger light scattering effect in the high wavelength region (800 to 1,000 nanometers) indicates the presence of larger particles or agglomerates of particles. Films containing the cyclohexane treated perylene have a significantly lower light scattering effect as compared to those containing perylenes processed in other solvents.

In another embodiment, sublimed benzimidazole perylene is processed using an attritor. The attritor is filled with enough ⅛ inch steel balls to completely cover the upper arms of the agitator. One part of BZP photogenerating pigment and 7 to 100 parts of cyclohexane are added to the attritor tank. The rotation speed of the agitator arm is set at about 100 to about 300 rpm. For the large 10 gallon attritor, a lower speed of 150 rpm is preferred. Temperature control of the pigment/solvent mixture is maintained by circulating coolant through the outer jacket of the attritor typically set at 15° to 20° C. in order to minimize evaporation loss of solvent. An aliquot of pigment/cyclohexane is withdrawn periodically and examined using the electron microscope. After 48 hours, the pigment particles becomes less than 0.15 micron in length, and their aspect ratio is generally less than 3, and preferably from 1 to about 2.5.

The benzimidazole perylene particles prepared can be used directly in preparing thin generator layers for photoresponsive imaging members. For improved film generating coating properties and excellent mechanical properties, it is generally preferred to redisperse the prepared perylene pigment in a polymer solution such as polycarbonate in toluene or tetrahydrofuran, or polystyrene-b-vinylpyridine in toluene. Typically, the polymer solution contains about 0.01 to 1 part by weight of polymer and 10 parts of solvent. The final amount of perylene pigment dispersed in the polymer ranges from about 5 to 95 percent by weight, and preferably from about 30 to 80 percent. Photoresponsive members containing such a generator layer evidence improved qualities such as high photosensitivity and uniform dispersion quality. The benzimidazole perylene pigments obtained with the processes of the present invention possess, for example, improved photosensitivity and excellent dispersion quality in photoresponsive members after the pigment has been processed in cyclohexane and reduced to fine particles which are mostly between 0.05 and 0.15 micron in length, and have a small aspect ratio of from 1 to 3. The processing accomplished in other solvents for the particle reduction step tends to produce larger particles greater than 0.2 micron and having a large aspect ratio greater than 5, such as 6 to 10.

The substrate for the photoconductive imaging member can be formulated entirely of an electrically conductive material, or it can be comprised of an insulating material having an electrically conductive surface. The substrate can be of an effective thickness, generally up to about 100 mils, and preferably from about 1 to about 50 mils, although the thickness can be outside of this range. The thickness of the substrate layer depends on many factors, including economic and mechanical considerations. Thus, this layer may be of substantial thickness, for example over 100 mils, or of minimal thickness provided that there are no adverse effects thereof. In a particularly preferred embodiment, the thickness of this layer is from about 3 mils to about 10 mils. The substrate can be opaque or substantially transparent and can comprise numerous suitable materials having the desired mechanical properties. The entire substrate can comprise the same material as that in the electrically conductive surface, or the electrically conductive surface can merely be a coating on the substrate. Any suitable electrically conductive material can be employed. Typical electrically conductive materials include copper, brass, nickel, zinc, chromium, stainless steel, conductive plastics and rubbers, aluminum, semitransparent aluminum, steel, cadmium, titanium, silver, gold, paper rendered conductive by the inclusion of a suitable material therein or through conditioning in a humid atmosphere to ensure the presence of sufficient water content to render the material conductive, indium, tin, metal oxides, including tin oxide and indium tin oxide, and the like. The substrate layer can vary in thickness over substantially wide ranges depending on the desired use of the electrophotoconductive member. Generally, the conductive layer ranges in thickness of from about 50 Angstroms to many centimeters, although the thickness can be outside of this range. When a flexible electrophotographic imaging member is desired, the thickness typically is from about 100 Angstroms to about 750 Angstroms. The substrate can be of any other conventional material, including organic and inorganic materials. Typical substrate materials include insulating nonconducting materials such as various resins known for this purpose including polycarbonates, polyamides, polyurethanes, paper, glass, plastic, polyesters, such as MYLAR® (available from E. I. DuPont) or MELINEX 447® (available from ICI Americas, Inc.), and the like. If desired, a conductive substrate can be coated onto an insulating material. In addition, the substrate can comprise a metallized plastic, such as titanized or aluminized MYLAR®, wherein the metallized surface is in contact with the photogenerating layer or any other layer situated between the substrate and the photogenerating layer. The coated or uncoated substrate can be flexible or rigid, and can have any number of configurations, such as a plate, a cylindrical drum, a scroll, an endless flexible belt, or the like. The outer surface of the substrate preferably comprises a metal oxide such as aluminum oxide, nickel oxide, titanium oxide, and the like.

In embodiments, intermediate adhesive layers situated between the substrate and subsequently applied layers may be desirable to improve adhesion. When such adhesive layers are utilized, they preferably have a dry thickness of from about 0.1 micron to about 5 microns, although the thickness can be outside of this range. Typical adhesive layers include film forming polymers such as polyester, polyvinylbutyral, polyvinylpyrrolidone, polycarbonate, polyurethane, polymethylmethacrylate, and the like as well as mixtures thereof. Since the surface of the substrate can be a metal oxide layer or an adhesive layer, the expression substrate can include a metal oxide layer with or without an adhesive layer on a metal oxide layer.

The photogenerating layer is of an effective thickness, for example, of from about 0.05 micron to about 10 microns or more, and in embodiments has a thickness of from about 0.2 micron to about 2 microns. The thickness of this layer can be dependent primarily upon the concentration of photogenerating material in the layer, which may generally vary from about 5 to 100 percent. The 100 percent value generally occurs when the photogenerating layer is prepared by vacuum evaporation of the pigment or by coating a binderless dispersion of the photogenerator pigment, such as BZP, onto the photoreceptor. When the photogenerating material is present in a binder material, the binder preferably contains from about 20 to about 95 percent by weight of the photogenerating material, and from about 50 to about 80 percent by weight of the photogenerating material. Generally, it is desirable to provide this layer in a thickness sufficient to absorb about 90 to about 95 percent or more of the incident radiation which is directed upon it in the imagewise or printing exposure step. The maximum thickness of this layer is dependent primarily upon factors such as mechanical considerations, such as the specific photogenerating compound selected, the thicknesses of the other layers, and whether a flexible photoconductive imaging member is desired. The perylene photogenerating pigment is preferably not dispersed in a resinous binder.

Typical transport layers are described, for example, in U.S. Pat. Nos. 4,265,990; 4,609,605; 4,297,424 and 4,921,773, the disclosures of each of these patents being totally incorporated herein by reference. Organic charge transport materials can also be employed. Typical charge, especially hole, transporting materials include the following.

Hole transport molecules of the type described in U.S. Pat. Nos. 4,306,008; 4,304,829; 4,233,384; 4,115,116; 4,299,897; 4,081,274 and 5,139,910, the disclosures of each being totally incorporated herein by reference, can be selected for the imaging members of the present invention. Typical diamine hole transport molecules include N,N'-diphenyl-N,N'-bis(3-methylphenyl)-(1,1'-biphenyl)-4,4'-diamine, N,N'-diphenyl-N,N'-bis(4-methylphenyl)-(1,1'-biphenyl)-4,4'-diamine, N,N'-diphenyl-N,N'-bis(2-methylphenyl)-(1,1'-biphenyl)-4,4'-diamine, N,N'-diphenyl-N,N'-bis(3-ethylphenyl)-(1,1'-biphenyl)-4,4'-diamine, N,N'-diphenyl-N,N'-bis(4-ethylphenyl)-(1,1'-biphenyl)-4,4'-diamine, N,N'-diphenyl-N,N'-bis(4-n-butylphenyl)-(1,1'-biphenyl)-4,4'-diamine, N,N'-diphenyl-N,N'-bis(3-chlorophenyl)-(1,1'-biphenyl)-4,4'-diamine, N,N'-diphenyl-N,N'-bis(4-chlorophenyl)-(1,1'-biphenyl)-4,4'-diamine, N,N'-diphenyl-N,N'-bis(phenylmethyl)-(1,1'-biphenyl)-4,4'-diamine, N,N,N',N'-tetraphenyl-[2,2'-dimethyl-1,1'-biphenyl]-4,4'-diamine, N,N,N',N'-tetra-(4-methylphenyl)-[2,2'-dimethyl-1,1'-biphenyl]-4,4'-diamine, N,N'-diphenyl-N,N'-bis(4-methylphenyl)-[2,2'-dimethyl-1,1'-biphenyl]-4,4'-diamine, N,N'-diphenyl-N,N'-bis(2-methylphenyl)-[2,2'-dimethyl-1,1'-biphenyl]-4,4'-diamine, N,N'-diphenyl-N,N'-bis(3-methylphenyl)-[2,2'-dimethyl-1,1'-biphenyl]-4,4'-diamine, N,N'-diphenyl-N,N'-bis(3-methylphenyl)-pyrenyl-1,6-diamine, and the like.

In embodiments of the present invention, the preferred hole transport layer, since it enables excellent effective transport of charges, is comprised of aryldiamine components as represented, or essentially represented, by the following general formula

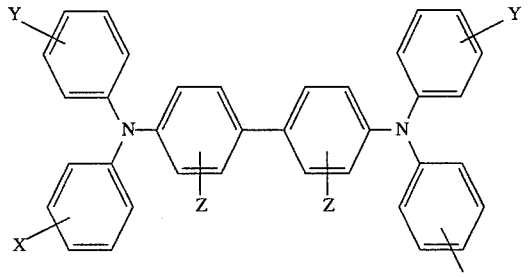

wherein X, Y and Z are selected from the group consisting of hydrogen, an alkyl group with, for example, from 1 to about 25 carbon atoms and a halogen, preferably chlorine, and at least one of X, Y and Z is independently an alkyl group or chlorine. When Y and Z are hydrogen, the charge transport molecules are N,N'-diphenyl-N,N'-bis(alkylphenyl)-(1,1'-biphenyl)-4,4'-diamine wherein alkyl is, for example, methyl, ethyl, propyl, n-butyl, or the like, or N,N'-diphenyl-N,N'-bis(chlorophenyl)-(1,1'-biphenyl)-4,4'-diamine.

The charge transport material is present in the charge transport layer in an effective amount, generally from about 5 to about 90 percent by weight, preferably from about 20 to about 75 percent by weight, and more preferably from about 30 to about 60 percent by weight.

Examples of the highly insulating and transparent resinous components or inactive binder resinous material for the transport layer include materials, such as those described in U.S. Pat. No. 3,121,006, the disclosure of which is totally incorporated herein by reference. Specific examples of suitable organic resinous materials include polycarbonates, acrylate polymers, vinyl polymers, cellulose polymers, polyesters, polysiloxanes, polyamides, polyurethanes, polystyrenes, and epoxies as well as block, random or alternating copolymers thereof. Preferred electrically inactive binder materials are polycarbonate resins having a molecular weight of from about 20,000 to about 100,000 with a molecular weight in the range of from about 50,000 to about 100,000 being particularly preferred. Generally, the resinous binder contains from about 5 to about 90 percent by weight of the active material corresponding to the foregoing formula, and preferably from about 20 percent to about 75 percent of this material.

Similar binder materials may optionally be selected for the photogenerating layer, including polyesters, polyvinyl butyrals, polyvinylcarbazole, polycarbonates, polyvinyl formals, poly(vinylacetals) and those illustrated in U.S. Pat. No. 3,121,006, the disclosure of which is totally incorporated herein by reference.

The photoconductive imaging member may optionally contain a charge blocking layer situated between the conductive substrate and the photogenerating layer. This layer may comprise metal oxides, such as aluminum oxide and the like, or materials such as silanes and nylons. Additional examples of suitable materials include polyisobutyl methacrylate, copolymers of styrene and acrylates such as styrene/n-butyl methacrylate, copolymers of styrene and vinyl toluene, polycarbonates, alkyl substituted polystyrenes, styrene-olefin copolymers, polyesters, polyurethanes, polyterpenes, silicone elastomers, mixtures thereof, copolymers thereof, and the like. The primary purpose of this layer is to prevent charge injection from the substrate during and after charging. This layer is of a thickness of less than 50 Angstroms to about 10 microns, preferably being no more than about 2 microns.

In addition, the photoconductive imaging member may also optionally contain an adhesive interface layer situated between the hole blocking layer and the photogenerating layer. This layer may comprise a polymeric material such as polyester, polyvinyl butyral, polyvinyl pyrrolidone and the like. Typically, this layer is of a thickness of less than about 0.6 micron.

The perylene photogenerating compounds of the present invention in embodiments thereof enable enhanced photosensitivity in the visible wavelength range. In particular, imaging members with photosensitivity at wavelengths of from about 400 to about 800 nanometers are provided in embodiments of the present invention, which renders them particularly useful for color copying, and imaging and printing applications, such as red LED and diode laser printing processes, which typically require sensitivity of about 600 to about 800 nanometers.

The present invention also encompasses a method of generating images with the photoconductive imaging members disclosed herein. The method comprises the steps of generating an electrostatic latent image on a photoconductive imaging member of the present invention, developing the latent image with a toner comprised of resin, pigment like carbon black, and a charge additive, and transferring the developed electrostatic image to a substrate. Optionally, the transferred image can be permanently affixed to the substrate. Development of the image may be achieved by a number of methods, such as cascade, touchdown, powder cloud, magnetic brush, and the like. Transfer of the developed image to a substrate may be by any method, including those making use of a corotron or a biased roll. The fixing step may be performed by means of any suitable method, such as flash fusing, heat fusing, pressure fusing, vapor fusing, and the like. Any material used in xerographic copiers and printers may be used as a substrate, such as paper, transparency material, or the like.

Specific embodiments of the invention will now be described in detail. These Examples are intended to be illustrative, and the invention is not limited to the materials, conditions, or process parameters set forth in these embodiments. All parts and percentages are by weight unless otherwise indicated.

EXAMPLE I

Preparation of Fine Particles of Perylene

The starting material is sublimed benzimidazole perylene which is obtained by the vacuum sublimation process as described in U.S. Pat. No. 5,225,307, the disclosure of which is totally incorporated herein by reference. It contains large particles up to about seven millimeters in length. Particle size reduction of the sublimed perylene was accomplished by ball milling in different organic solvents of cyclohexane, and other solvents of methylene chloride, chlorobenzene, tetrahydrofuran, toluene, methanol, butanol, methyl ethyl ketone, cyclohexanone, butyl acetate and dimethylformamide. 0.2 Gram of sublimed perylene pigment, 8 milliliters of the solvent in each instance, and 70 grams of ⅛ inch steel balls were placed in 30 milliliter bottles which were then put on a Norton jar mill operating at 300 rpm. After 5 days, a drop of dispersion mixture was withdrawn from each bottle and examined under transmission electron microscope. The pigment particles obtained from milling in cyclohexane were between 0.05 to 0.15 micron in length and a majority of them (70 percent) were between 0.05 to 0.1 micron, and possess a brick shape appearance which had a low aspect ratio (length/width) ranging from 1 to 3. The particles obtained in the other solvents were rods which were generally between 0.15 to 0.50 micron in length and possessed a larger aspect ratio of 5 to 10. The results indicated that cyclohexane had a special influence in more effectively reducing particle size and obtaining the desired aspect ratio which enables a higher photosensitivity in perylene as compared to perylenes obtained in the other solvents of this Example.

EXAMPLE II

Xerographic Properties of Benzimidazole Perylene Photoconductive Members

Photoconductive imaging members were fabricated using the milled perylene dispersions as prepared in Example I. The base substrate of each imaging device was titanized MYLAR® of 75 microns in thickness with a silane layer, 0.1 micron in thickness, thereover, and E. I. DuPont 49,000 polyester adhesive thereon in a thickness of 0.1 micron. The photogenerator layers were formed by coating dispersions of photogenerating pigments onto the substrate using a 1.5 mil film applicator. After drying at 135° C. for 20 minutes in a forced air oven, the photogenerating layer had a final thickness of about 1 micron. Thereafter, the above photogenerating layer present in the respective imaging members were each overcoated with an amine charge transport layer prepared as follows. A transport layer solution was prepared by mixing 8.3 grams of MAKROLON™, a polycarbonate resin, 4.4 grams of N,N'-diphenyl-N,N'-bis(3-methylphenyl)-(1,1'-biphenyl)-4,4'-diamine and 82.3 grams of methylene chloride. The solution was coated onto the above photogenerating layer using a film applicator of 10 mil gap. The resulting members were dried at 135° C. in a forced air oven for 20 minutes, and the final dried thickness of the transport layer was 20 microns.

The xerographic electrical properties of each imaging member were then determined by electrostatically charging its surface with a corona discharging device until the surface potential, as measured by a capacitively coupled probe attached to an electrometer, attained an initial value $V_o$. After resting for 0.5 second in the dark, the charged member reached a surface potential of $V_{ddp}$, dark development potential, and was then exposed to light from a filtered xenon lamp. A reduction in the surface potential to $V_{bg}$, background potential, due to photodischarge effect was observed. The dark decay in volt/second was calculated as $(V_o-V_{ddp})/0.5$. The lower the dark decay value, the better the ability of the member to retain its charge prior to exposure by light. Similarly, the lower the $V_{ddp}$, the poorer the charging behavior of the member. The percent photodischarge was calculated as 100 percent$\times(V_{ddp}-V_{bg})/V_{ddp}$. The light energy used to photodischarge the imaging members during the exposure step was measured with a light meter. The photosensitivity of the imaging member can be described in terms of $E_{1/2}$, amount of exposure energy in erg/cm$^2$ required to achieve 50 percent photodischarge from the dark development potential. The higher the photosensitivity, the smaller the $E_{1/2}$ value. High photosensitivity (lower $E_{1/2}$ value), lower dark decay and high charging are desired for the improved performance of xerographic imaging members.

The following Table 1 summarizes the xerographic electrical results of the imaging members containing benzimidazole perylene (BZP) particles prepared from milling in different solvents.

TABLE 1

| Imaging Member No. | Solvent Used in Milling Benzimidazole Perylene | Dark Decay V/s | $E_{1/2}$ erg/cm$^2$ |
|---|---|---|---|
| 1 | Cyclohexane | 30 | 2.4 |
| 2 | Methylene Chloride | 24 | 3.4 |
| 3 | Chlorobenzene | 22 | 4.1 |
| 4 | Tetrahydrofuran | 26 | 4.5 |
| 5 | Toluene | 61 | 3.9 |
| 6 | Methanol | 38 | 3.3 |
| 7 | Butanol | 16 | 4.0 |
| 8 | Methylethyl Ketone | 38 | 4.1 |
| 9 | Cyclohexanone | 14 | 3.7 |
| 10 | Butyl Acetate | 85 | 3.0 |
| 11 | Dimethylformamide | 11 | 5.5 |

The fine perylene particles obtained in cyclohexane possess the highest sensitivity as reflected from the lowest measured $E_{1/2}$ value. Comparison with the other solvents, indicates that the magnitude of the improvement in sensitivity with cyclohexane treatment varied from 25 percent to 220 percent as additional exposure energy was needed to achieve the same 50 percent photodischarge level. Furthermore, the cyclohexane treated perylene has a moderate dark decay of 30 V/s.

EXAMPLE III

Attrition of Perylene

Instead of ball milling method as illustrated herein, the particle size reduction of benzimidazole perylene (BZP) photogenerating pigment in cyclohexane was accomplished in an attritor. Five (5) grams of sublimed benzimidazole perylene, obtained by the process as described in U.S. Pat. No. 5,225,307, was placed in an Union Process Model O1 attritor, which contained 180 milliliters of cyclohexane and 1.8 killigrams of ⅛ inch stainless steel balls. The attrition was accomplished at 300 rpm at a temperature of 15° C. A 10 milliliter aliquot of the BZP dispersion sample was withdrawn at 5, 11, 24, 48 and 72 hours for examination under transmission electron microscope and for the preparation of photoconductive members as described in Examples I and II. TEM measurements confirmed that fine particles of 0.05 to 0.1 micron in length were obtained. The BZP dispersion with a shorter attrition time contained large particles, 0.5 micron in length. The xerographic results obtained are shown in the following Table 2. The optimum attrition time for generating high photosensitivity BZP with fine particles was from about 48 to 72 hours.

TABLE 2

| Attrition Time Hr. | Dark Decay V/s | $E_{1/2}$ erg/cm$^2$ |
|---|---|---|
| 5 | 20 | 4.8 |
| 11 | 20 | 3.5 |
| 24 | 20 | 2.9 |
| 48 | 20 | 2.6 |
| 72 | 29 | 2.4 |

EXAMPLE IV

Binder Generator Photoconductive Members Containing Benzimidazole Perylene Milled in Cyclohexane To further improve the mechanical and adhesion properties of the BZP charge generator layer in photoconductive members, the BZP pigment was dispersed in polymeric binder. In accordance with Example I, 0.2 gram sublimed of benzimidazole perylene was initially milled in 8.1 milliliters of cyclohexane for 5 days. After removing the cyclohexane from the milled dispersion by evaporation at 30° C. for 20 hours, the remaining fine powder of benzimidazole perylene was redispersed in the solution of 0.3 gram of polycarbonate PC(z) in 8.1 milliliters of toluene to form a generator dispersion (IVA). For comparison, a reference dispersion (IVB) was prepared by directly milling 0.2 gram sublimed benzimidazole perylene, 0.3 gram PC(z), and 8.1 milliliters of toluene. The pigment loading, that is the weight of pigment divided by the total weight of pigment and PC(z), in the photogenerator layer was 40 weight percent in both instances. Photoconductive members were fabricated using dispersions (IVA) and (IVB) in accordance with Example II. The xerographic electricals of these members are summarized in the following Table 3.

TABLE 3

| Generator Dispersion | Dark decay V/s | $E_{1/2}$ erg/cm$^2$ |
|---|---|---|
| (IVA) Perylene Milled in Cyclohexane and Redispersed in PC(z)/Toluene | 25 | 3.9 |
| (IVB) Reference Dispersion: Perylene Milled in PC(z)/Toluene | 25 | 4.7 |

There was a 20 percent improvement in photosensitivity for the perylene previously milled in cyclohexane as compared to the reference dispersion wherein the perylene was not subjected to milling in cyclohexane.

EXAMPLE V

Binder Generator Photoconductive Members Containing Benzimidazole Perylene Milled in Cyclohexane Following the process of Example III, the processes were repeated using a block copolymer of polystyrene-b-vinylpyridine instead of polycarbonate PC(z). The dispersion (VA) now contained cyclohexane milled perylene which was redispersed in the solution of toluene and polystyrene-b-vinylpyridine. The dispersion (VB) contained perylene dispersed in the polystyrene-b-vinylpyridine/toluene. Photoconductive members were then prepared from these two dispersions and their xerographic characteristics are compared in the following Table 4.

TABLE 4

| Generator Dispersion | Dark Decay V/s | $E_{1/2}$ erg/cm$^2$ |
|---|---|---|
| (VA) Perylene Milled in Cyclohexane and Redispersed in Copolymer/Toluene | 18 | 4.6 |
| (VB)Reference Dispersion: Perylene Milled in Coplymer/Toluene | 15 | 5.9 |

A higher sensitivity, about 30 percent, was observed for the photoconductive member that contained the cyclohexane milled perylene.

Other embodiments and modifications of the present invention may occur to those skilled in the art subsequent to a review of the information presented herein; these embodiments and modifications, as well as equivalents thereof, are also included within the scope of this invention.

What is claimed is:

1. An imaging member comprised of a supporting substrate, a photogenerator layer comprised of the cis and trans isomers of benzimidazole perylene, and wherein said isomers are obtained by the milling thereof with cyclohexane, and a charge transport layer.

2. An imaging member in accordance with claim 1 wherein the photogenerating perylene is dispersed in a resinous binder in an amount of from about 5 percent by weight to about 95 percent by weight.

3. An imaging member in accordance with claim 1 wherein the charge transport layer is comprised of aryl amine molecules of the formula

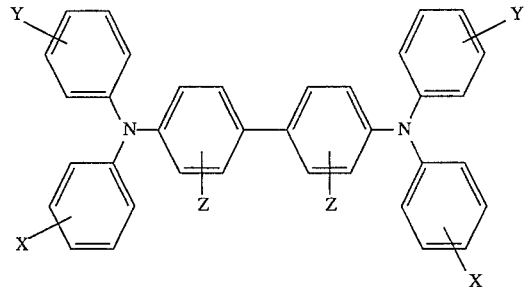

wherein X is selected from the group consisting of alkyl and halogen, and wherein the aryl amine is dispersed in a highly insulating and transparent organic resinous binder.

4. An imaging me tuber in accordance with claim 1 wherein the cis isomer is bisbenzimidazo(2,1-a:1',2'-b')anthra(2,1,9-def:6,5,10 -d'e'f')diisoquinoline-6,11-dione and the trans isomer is bisbenzimidazo(2,1-a:2',1'-a')anthra(2,1,9-def:6,5,10-d'e'f')diisoquinoline-10,21-dione.

* * * * *